US012448736B2

(12) United States Patent
Vian et al.

(10) Patent No.: US 12,448,736 B2
(45) Date of Patent: Oct. 21, 2025

(54) BALLASTLESS TRACK SECTION FOR A RAIL VEHICLE

(71) Applicant: SYSTRA, Paris (FR)

(72) Inventors: David Vian, Paris (FR); Youcef Alloui, Merignac (FR); Mathilde Le Guennec, Paris (FR); Marcel Girardi, Ifs (FR); Jérôme Olive, Paris (FR)

(73) Assignee: SYSTRA, Paris (FR)

( * ) Notice: Subject to any disclaimer, the term of this patent is extended or adjusted under 35 U.S.C. 154(b) by 1023 days.

(21) Appl. No.: 17/599,536

(22) PCT Filed: Mar. 16, 2020

(86) PCT No.: PCT/FR2020/050561
§ 371 (c)(1),
(2) Date: Sep. 28, 2021

(87) PCT Pub. No.: WO2020/193911
PCT Pub. Date: Oct. 1, 2020

(65) Prior Publication Data

US 2022/0162806 A1 May 26, 2022

(30) Foreign Application Priority Data

Mar. 28, 2019 (FR) ..... 1903225

(51) Int. Cl.
*E01B 3/40* (2006.01)
*E01B 1/00* (2006.01)

(52) U.S. Cl.
CPC ..... *E01B 3/40* (2013.01); *E01B 1/002* (2013.01)

(58) Field of Classification Search
CPC ..... E01B 3/00; E01B 3/28; E01B 3/36; E01B 3/38; E01B 3/40
USPC ..... 238/7, 25, 109, 115
See application file for complete search history.

(56) References Cited

U.S. PATENT DOCUMENTS

2011/0220730 A1* 9/2011 Thel ..... E01B 3/38 238/115
2018/0148896 A1 5/2018 Vian

FOREIGN PATENT DOCUMENTS

| | | | | |
|---|---|---|---|---|
| CN | 108914714 | | 11/2018 | |
| EP | 0718438 | A1 * | 6/1996 | ..... E01B 3/40 |
| EP | 2184402 | | 5/2010 | |
| EP | 2184402 | A1 * | 5/2010 | ..... E01B 1/002 |
| FR | 3036711 | A1 * | 12/2016 | ..... E01B 1/002 |

(Continued)

*Primary Examiner* — S. Joseph Morano
*Assistant Examiner* — Heaven R Buffington
(74) *Attorney, Agent, or Firm* — CRGO Global; Steven M. Greenberg

(57) ABSTRACT

The invention relates to a ballastless track section for a rail vehicle, said section being fastened to a platform (10) and comprising: a prefabricated concrete track slab (20, 120) comprising two stringers (21, 22); a rounded bearing surface (21c, 22c) borne by an underside of each stringer at each longitudinal end and having a curvature, the center of curvature of which is the top of a rail (21b, 22b) borne by the stringer; a prefabricated support pad (30, 130) for supporting each longitudinal end of the slab (20, 120) and comprising at least two support bases (33, 34) for the two stringers of this longitudinal end of the slab, each base (33, 34) comprising at least one shim (33a, 34a) of predetermined thickness supporting said rounded bearing surface (21c, 22c) of the stringer of said slab facing this base.

10 Claims, 3 Drawing Sheets

(56) References Cited

FOREIGN PATENT DOCUMENTS

| | | | | |
|---|---|---|---|---|
| WO | WO2018145169 | | 8/2018 | |
| WO | WO-2018145169 | A1 * | 8/2018 | ..... E01B 2/00 |

* cited by examiner

[Fig. 1]
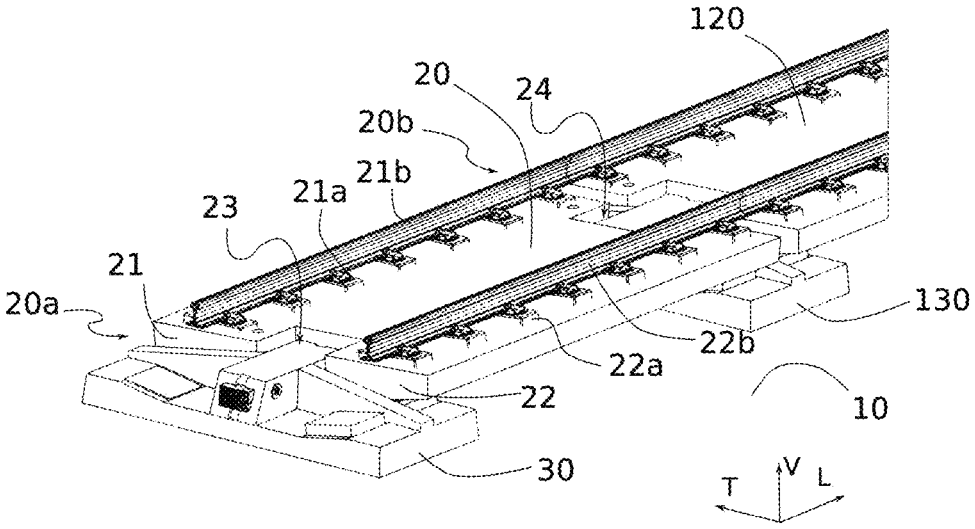
[Fig. 2]
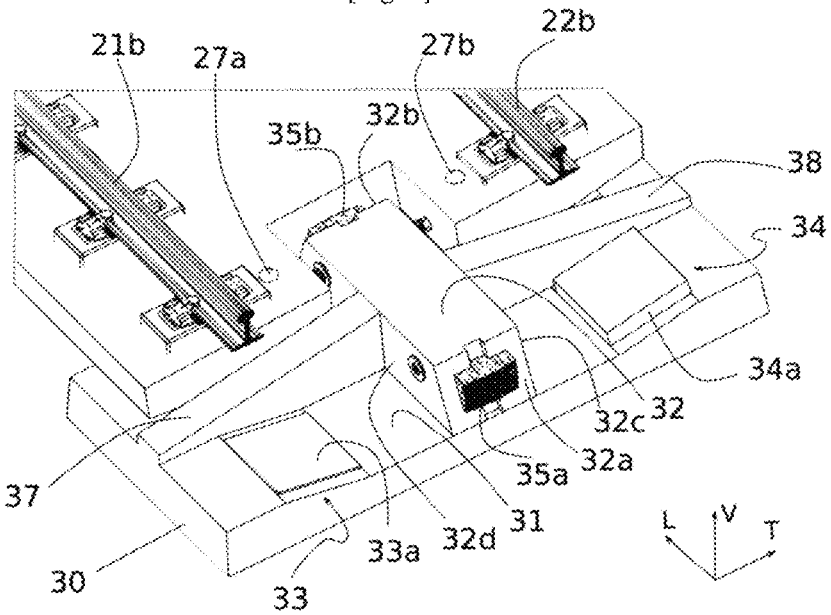

[Fig. 3]
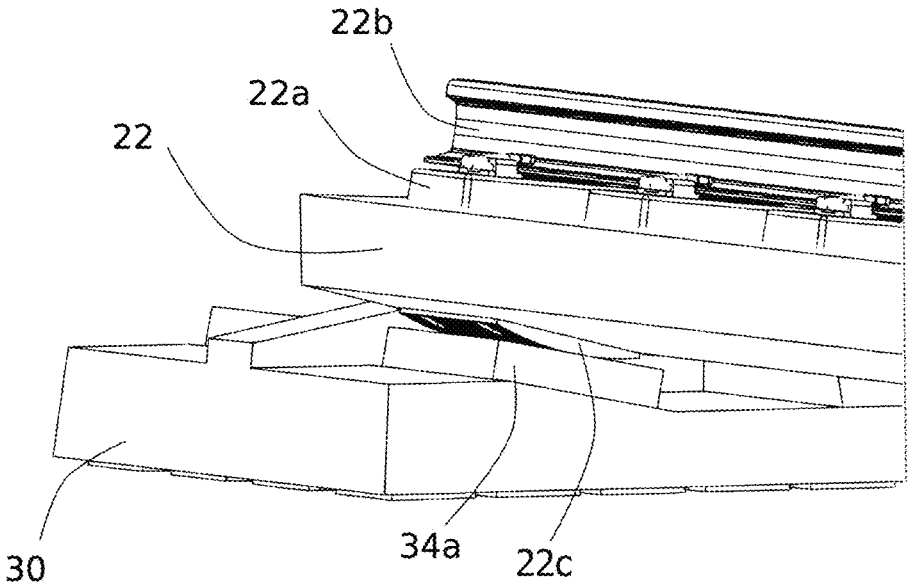
[Fig. 4]
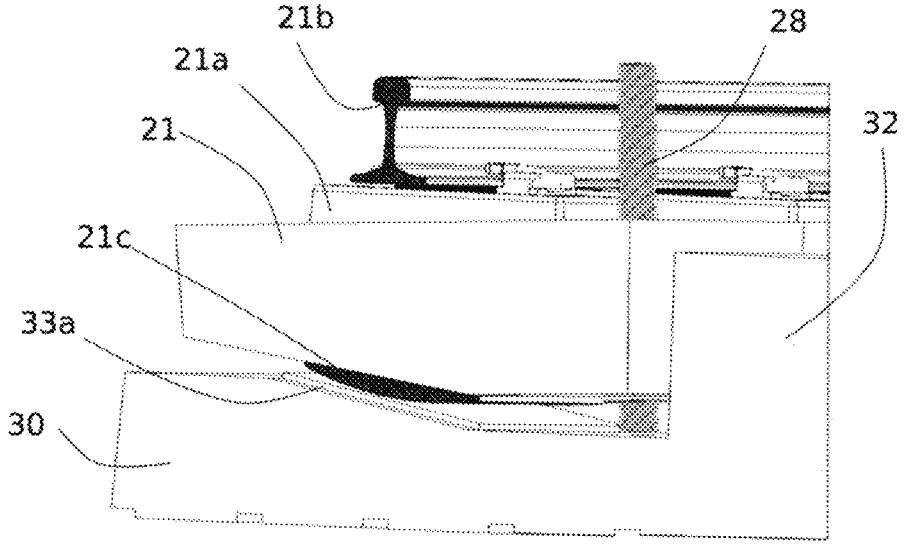

[Fig. 5]
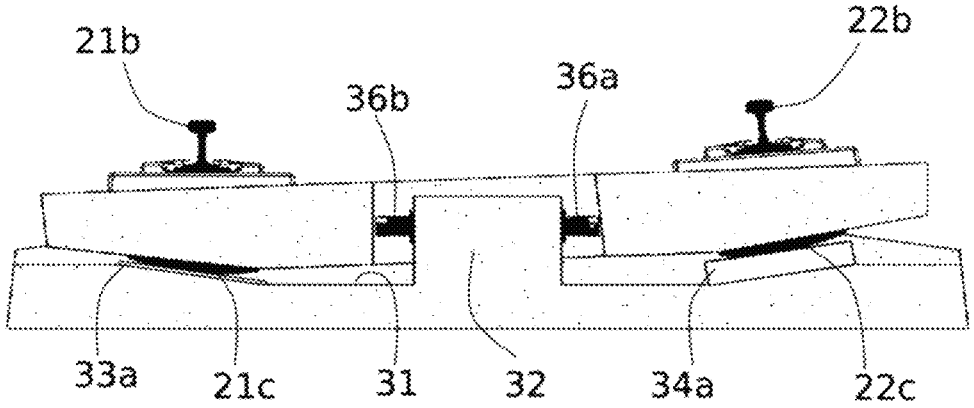

BALLASTLESS TRACK SECTION FOR A RAIL VEHICLE

CROSS-REFERENCE TO RELATED APPLICATIONS

This application is a § 371 national phase entry of International Application No. PCT/FR2020/050561, filed Mar. 16, 2020, which claims priority to French Patent Application No. 1903225, filed Mar. 28, 2019.

TECHNICAL FIELD OF THE INVENTION

The invention relates to a ballastless railway track for a rail vehicle. The invention more particularly relates to a track section for a rail vehicle intended to allow a running track for a rail vehicle to be manufactured by placing a plurality of track sections according to the invention end-to-end.

TECHNICAL BACKGROUND

Since the emergence of railway tracks, it has been known to install these tracks on ballast, i.e. on a bed of crushed stones or gravel. The ballast allows the forces transmitted by the crossties under the action of the rolling loads to be distributed over the platform of the underlying track. The ballast thus makes it possible to limit the compaction of the platform. The ballast also makes it possible to embed the crossties in order to limit their displacements and their deformation.

For several years, ballastless track projects have multiplied, particularly tracks on concrete slabs. In fact, a ballastless track has the advantages of minimizing the maintenance costs of the track and of extending its lifespan.

Such a ballastless track generally comprises a concrete or asphalt foundation layer, on which a concrete slab is placed that is cast in place or is prefabricated and is intended to support and anchor the rails of the track.

One of the difficulties encountered when making such a ballastless track is the precision required when laying concrete slabs on the underlying foundation layer, since this directly determines the geometry of the track. In addition, when a cant is necessary on the route of the track, the earthworks of the foundation layer must be adapted to form the cant prior to the installation of the concrete slabs. The adjustment of the center distance can also pose technical difficulties. Finally, after adjusting the geometry of the track, it is necessary to seal or anchor the concrete slabs so that they are permanently immobilized.

The applicant has thus already proposed a ballastless track for a guided transport vehicle comprising a track platform and a plurality of track sections each comprising a track panel formed by two stringers extending along a longitudinal axis, each stringer further comprising an upper longitudinal groove for receiving a rail, and crossties secured to the stringers and extending transversely therebetween. The track section already proposed by the applicant further comprises a plurality of panel bearing surfaces configured to be able to support the panel above the track platform. The bearing surfaces each comprise a fastening pad suitable for being fastened to the platform, a cradle suitable for supporting the panel, and means for vertical displacement of said cradle relative to said pad so as to be able to adjust the height of the panel relative to said platform and to define the cant of the track section. The vertical displacement means comprise a wedge shim resting on a bottom of a receptacle for receiving the pad, the shim bearing the cradle, which is mounted to move vertically along a vertical axis perpendicular to the longitudinal axis in the pad.

Such a track section thus allows the geometry of the track to be precisely adjusted following its installation on the track platform. In particular, the height of each stringer (and consequently the height of each rail housed in the groove of the stringer) can be adjusted, following its installation. This height of the stringer (i.e. the distance separating the platform from the stringer) is defined and regulated by a displacement of the support cradle of a stringer obtained by the displacement of the wedge shim of each bearing surface.

With this being the case, the inventors have sought to improve the proposed solution, in particular in order to be able to simplify the adjustment of the track and to propose a more compact version of the means for adjusting the track following its installation.

AIMS OF THE INVENTION

The invention aims to address at least some of the drawbacks of known ballastless tracks.

In particular, the invention aims to provide, in at least one embodiment, a track section whose geometry (cant, height) can be adjusted following its installation by simple and compact design means.

The invention also aims to provide a track section that does not require a concrete or mastic asphalt slab in order to be able to be installed.

The invention also aims to provide, in at least one embodiment, a track section that allows the geometry of the track thus formed to be corrected following its installation and at any time during the life of the track thus formed, in particular to compensate for compaction related to the operation of the track.

The invention also aims to provide, in at least one embodiment, a track section that can be quickly installed by the track laying crews.

The invention also aims to provide, in at least one embodiment, a track section that is easy to maintain.

The invention also aims to provide, in at least one embodiment, a track section that is not very susceptible to flooding.

The invention also aims to provide, in at least one embodiment, a track section that can be installed on different types of engineering structures, such as tunnels, viaducts, in particular U-shaped viaducts, bridges, booms, etc.

The invention also aims to provide, in at least one embodiment, a track section that limits its impact on the ecosystem where the track is located.

DISCLOSURE OF THE INVENTION

To this end, the invention relates to a ballastless track section for a rail vehicle intended to be fastened on a track platform, characterized in that said track section comprises:

- a prefabricated concrete track slab comprising two stringers extending along a longitudinal direction and, at each longitudinal end of the slab, a notch separating said stringers, so as to form an H-shaped track slab;
- for each stringer, a plurality of transverse supporting blocks for maintaining a longitudinal rail and mounted on an upper face of said stringer, and at each longitudinal end of the stringer, a rounded bearing surface borne by an underside of said stringer and having a curvature, the center of curvature of which is the top of said rail borne by the supporting blocks of this stringer;

for each longitudinal end of said slab, a prefabricated support pad of at least this longitudinal end of the slab, said prefabricated support pad comprising a plate and a longitudinal central block projecting from said plate intended to extend into the notch of this longitudinal end of said slab, once this slab is mounted on this pad, and delimiting, on either side of said central block, at least two support bases for the two longitudinal stringers of this longitudinal end of said slab, each base comprising at least one shim of predetermined thickness arranged on said plate and intended to support said rounded bearing surface of the stringer of said slab facing this base, once this slab is mounted on said pad;

for each support pad, foundation means for this support pad in said track platform.

The track section according to the invention is exclusively made up of prefabricated parts (prefabricated concrete slab and prefabricated support pads), which makes it possible to control the manufacturing quality of the parts and to facilitate the installation of the track section on a track platform. In addition, the use of prefabricated parts associated with means for adjusting the geometry of the track makes it possible to satisfy all the layout configurations of the track (alignments, curves, connections, slopes, etc.).

A track section according to the invention makes it possible to adjust the precise geometry of the track when it is installed and following its installation on a ballastless platform.

In particular, the height of each rail borne by the supporting blocks of each stringer can be adjusted following its installation. This rail height (i.e. the distance from the top of the rail to the platform) is defined and regulated by the track slab support pads (also referred to as the track panel throughout the text).

To this end, each support pad comprises a plate and a longitudinal central block projecting from the plate intended to extend into the notch of this longitudinal end, once this slab is mounted on this pad. In other words, the slab (or panel) is borne by two support blocks respectively arranged at each of these two longitudinal ends.

In addition, the central block of each pad delimits at least two support bases for the two stringers of this longitudinal end of the slab, each base comprising at least one shim of predetermined thickness arranged on the plate and intended to support the rounded bearing surface, which has a curved surface whose center of curvature is the top of the rail borne by the supporting blocks of this stringer.

This particular structure of the pad makes it possible to form a system for adjusting the height and the cant of the track section simply, with a reduced number of parts.

In particular, a track section according to the invention does not require forming a cant directly on the earthwork of the track prior to the installation of the track. This cant can be formed following installation, by an inclination of the track slab, which facilitates the track laying operations.

This inclination results from a stack of shims on one of the bases of the pad for pivoting the slab about a longitudinal axis. In particular, the rounded bearing surface in contact with the shims having a curvature with a center of curvature coinciding with the top of the rail, the vertical displacement of the stringer that results from a stack of shims of predetermined thickness causes the slab to pivot about a longitudinal axis.

Adjusting the heights of the shims also allows vertical and/or lateral adjustment of the slab.

A track section according to the invention therefore makes it possible, by adapting the height of the shims and/or by stacking shims of predetermined thickness on the bases of the pad, to define the height of the slab and its inclination.

A track section according to the invention also allows compensation of the differential compaction of the track platform by individual adjustment of each pad. The functionality of adjusting the track section according to the invention also allows adjustment and correction of the geometry of the track during its lifetime. The precision of the earthwork is also less critical than with the tracks of the prior art due to the possibility of being able to subsequently refine the height of each stringer relative to the platform and to make up for any earthwork faults.

Advantageously and according to the invention, at least one pad comprises, on either side of the central block, two support bases for two stringers separated by a transverse stiffening wall, so that this pad can support two longitudinal ends of two consecutive slabs.

This advantageous variant makes it possible to use the same pad to support two longitudinal ends of two successive slabs. In other words, a pad according to this variant forms the link between two consecutive slabs to form a railway track. The pad then comprises two pairs of bases (four bases in total), with each pair of bases being configured to bear a longitudinal end of one of the two consecutive slabs.

In addition, the transverse stiffening wall acts as a stiffener for the pad in the transverse direction.

Advantageously and according to the invention, said central block of at least one support pad, in particular of each support pad, comprises at least one longitudinal stop borne by a longitudinal wall of said central block so as to be able to block any longitudinal displacement of the slab whose notch receives this longitudinal wall of the central block.

According to this advantageous variant, the central block bears a longitudinal stop of the slab to prevent any longitudinal displacement of the slab relative to the support pad.

This longitudinal stop is for example made of an elastomeric material.

In the case where the pad is configured to bear two longitudinal ends of two consecutive slabs, the central block preferably comprises a longitudinal stop on each of its two longitudinal walls in order to be able to block any longitudinal displacement of each of the two slabs borne by this pad.

Advantageously and according to the invention, said central block of at least one pad comprises at least one lateral stop mounted on a side wall of said central block so as to be able to block any lateral displacement of the slab, the notch of which receives this side wall of the central block.

According to this advantageous variant, the central block bears a lateral stop of the slab in order to prevent any lateral displacement of the slab relative to the support pad. This lateral stop is for example made of an elastomeric material. Preferably, the central block comprises two lateral stops respectively mounted on the two side walls of the central block in order to be able to block any lateral displacement (whatever the direction of displacement) of the slab relative to the pad.

In the case where the pad is configured to bear two longitudinal ends of two consecutive slabs, the central block preferably comprises two lateral stops for each of the two slabs (in other words, four lateral stops in all).

Advantageously and according to the invention, said central block of at least one pad comprises at least one adjustable lateral stop so as to be able to define the lateral space that separates said central block from each slab borne by this pad.

According to this advantageous variant, at least one lateral stop, preferably each lateral stop, is adjustable, i.e. it is possible to adjust the distance that separates the end of the lateral stop from the wall of the central block. This adjustment can for example be obtained by threaded means formed from an internal thread arranged in the side wall of the central block and by a stop that has a thread that is combined with the internal thread of the side wall. Screwing or unscrewing the stop in the internal thread makes it possible to define the distance that separates the side wall from the central block of the slab. This adjustment of the lateral stops makes it possible to adjust the placement of the slab in relation to the pad.

Advantageously and according to the invention, said bases of the shims of at least one pad are inclined toward said central block to allow better stability of each slab borne by this pad.

According to this advantageous variant, the bases of the shims are inclined toward the central block so as to form a truncated V. The shims are placed on the inclined branches of the V and receive the rounded bearing surfaces borne by the undersides of the slab stringers. This makes it possible to improve the stability of the assembly by concentrating the forces toward the central block.

Advantageously and according to the invention, said slab further comprises, at each longitudinal end, on either side of said notch, at least one threaded insert arranged in said slab and emerging facing said plate of the pad bearing this end of the slab, once the slab is mounted on said pad, so as to allow vertical lifting of said slab relative to the pad by screwing a lifting screw into said insert that bears against said plate of said pad.

This advantageous variant makes it possible to lift the slab vertically, during track adjustment operations, to add or remove adjustment shims and/or to adjust the adjustable lateral stops. According to another variant, the slab of the track section can be lifted vertically by using a hydraulic jack, such as a lifting jack or any equivalent means.

Advantageously and according to the invention, said foundation means for at least one pad in said track platform comprise at least one pile per stringer support base.

This advantageous variant makes it possible to ensure the anchoring of each pad in the platform by piles, preferably at least one pile per base. In other words, in the case where the pad comprises four bases for supporting two longitudinal ends of two successive slabs, the pad comprises four piles.

These piles can be of any type. They can be drilled, sunk or screwed into the platform depending on the nature of the soil and the bearing capacity to be obtained.

The foundation means for a pad of a track section according to the invention have a dual function of anchoring the pad in the platform and of bearing the ground under the pad.

A track section according to the invention can not only be anchored on a platform of a ballastless track using foundation means for the pads in the platform, but can also be installed on a bottom slab of a tunnel or an apron of a bridge or a viaduct, for example, in which case the pads are directly secured to the bottom slab of the tunnel or to the apron of the bridge or of the viaduct.

In the context of the production of a track with a plurality of track sections according to the invention, the piles of each pad can be chosen differently to adapt to the nature of the ground where the pad is located.

Advantageously and according to the invention, said rounded bearing surfaces of said longitudinal stringers of said slab are formed from an elastomer.

Advantageously and according to the invention, said shims of predetermined thickness arranged on said plate of said pad are made of steel.

The invention also relates to a ballastless track for a rail vehicle comprising a track platform and a plurality of track sections according to the invention successively fastened to said track platform.

The advantages and technical effects of a track section according to the invention apply mutatis mutandis to a ballastless track according to the invention.

The invention also relates to a track section and a track formed by a plurality of track sections, characterized in combination by all or some of the features mentioned above or below.

LIST OF FIGURES

Further aims, features and advantages of the invention will become apparent upon reading the following description, which is provided solely by way of a non-limiting example, and which refers to the accompanying figures, in which:

FIG. 1 is a schematic perspective view of a track section according to one embodiment of the invention;

FIG. 2 is a detailed schematic view of a pad and a longitudinal end of a track slab of the track section of FIG. 1;

FIG. 3 is a schematic side perspective view of the pad of FIG. 2;

FIG. 4 is a schematic side view of the pad of FIG. 3 further comprising means for lifting the track slab;

FIG. 5 is a schematic profile view of a track section according to one embodiment of the invention.

DETAILED DESCRIPTION OF ONE EMBODIMENT OF THE INVENTION

For the sake of illustration and of clarity, the scales and the proportions are not strictly adhered to in the figures. Throughout the following detailed description with reference to the figures, unless otherwise indicated, each element of a track section is described as it is arranged when the track section is anchored in a platform to form a running track of a rail vehicle. This configuration is shown in particular in FIG. 1.

The terms longitudinal, transverse and vertical are used in a non-limiting manner with reference to the trihedron L, T, V as shown in FIG. 1. The longitudinal direction corresponds to the direction of the rails of the track section and defines the direction of displacement of a rail vehicle using this track section. The vertical direction is the direction defined by the gravity of the installation site of the track section. The transverse direction is the direction perpendicular to the longitudinal direction and to the vertical direction.

Moreover, identical, similar or analogous elements are denoted using the same reference signs throughout the figures.

FIG. 1 schematically illustrates a track section according to one embodiment of the invention comprising a prefabricated concrete track slab 20 (also referred to using the term "track panel") and two pads 30, 130 arranged at each of the longitudinal ends 20*a*, 20*b* of the track slab 20. FIG. 1 also illustrates a portion of a second track slab 120, one longitudinal end of which rests on the pad 130, with the other longitudinal end of this second slab 120 resting on another pad not shown in FIG. 1.

Throughout the following, the same reference signs are used for the constituent elements of the slabs 20, 120 and of the pads 30, 130 for the sake of clarity and insofar as the features of the two pads and of the two slabs are identical.

The prefabricated concrete track slab 20 comprises two stringers 21, 22, which each extend along the longitudinal direction L. The slab 20 further has a notch 23, 24 at each of its longitudinal ends 20*a*, 20*b*. Thus, the slab 20 is generally H-shaped.

Each stringer 21, 22 also bears a plurality of transverse supporting blocks 21*a*, 22*a* for maintaining a longitudinal rail 21*b*, 22*b*. The supporting blocks 21*a*, 22*a* are for example formed from concrete and sealed in the track slab 20. The means for supporting the rails 21*b*, 22*b* can be of any type and are not described in detail herein.

Each stringer also comprises, at each of its longitudinal ends, and as shown in FIGS. 3 and 5, a rounded bearing surface 21*c*, 22*c*, for example made of elastomer, borne by an underside of the stringer. This rounded bearing surface 21*c*, 22*c* has a curvature whose center of curvature is the top of the rail 21*b*, 22*b* borne by this stringer.

In other words, the geometry of the rounded bearing surface 21*c*, 22*c* (and in particular its curvature) depends on the thickness of the slab, the height of the supporting blocks and the height of the rails borne by the supporting blocks so that, once these various elements are assembled, the center of curvature of the rounded bearing surface 21*c*, 22*c* coincides with the top of the rail 21*b*, 22*b*.

Each rounded bearing surface 21*c*, 22*c* rests on a stack of shims 33*a*, 34*a*, formed for example from steel. The height of the shims or the number of shims (in the case where the shims have identical thicknesses) make it possible to adjust the height and the cant of the track section.

The shims 33*a*, 34*a* rest on bases 33, 34. These bases 33, 34 are formed on a plate 31 of the pad and are separated from each other by a longitudinal central block 32. The plate 31 has the general shape of a truncated V, whereof the branches of the V form the bases inclined toward the longitudinal central block 32, which stands at the center of the truncated V.

Each branch of the truncated V preferably extends parallel to the lower surface of the stringer, which bears the rounded bearing surface arranged opposite the base formed by this branch of the truncated V.

The base 33 receives the stack of shims 33*a* on which the bearing surface 21*c* of the stringer 21 bears. The base 34 receives the stack of shims 34*a* on which the bearing surface 22*c* of the stringer 22 bears.

According to the embodiment of the figures, each pad 30, 130 comprises, on either side of the central block 32, two support bases for two stringers separated by a transverse wall 37, 38, so that this pad 30, 130 can support two longitudinal ends of two consecutive slabs. In other words, a pad according to the embodiment of the figures supports the two adjacent longitudinal ends of two consecutive track slabs. Each pad 30, 130 has, according to the embodiment of the figures, a symmetry with respect to a transverse plane (except for the heights of the shims, which can be different on either side of the plane of symmetry insofar as the adjustment of the two consecutive track slabs can be different from one slab to another).

Throughout the following, the same reference signs are used for each element on either side of this transverse plane of symmetry.

As shown in particular in FIG. 2, the central block 32 of the pad 30 also comprises two longitudinal walls 32*a*, 32*b* and two side walls 32*c*, 32*d*. Each longitudinal wall 32*a*, 32*b* further comprises a longitudinal stop 35*a*, 35*b*. Each longitudinal stop 35*a*, 35*b* is for example formed from an elastomer. It can for example be slidably mounted in a groove formed on the longitudinal wall 32*a*, 32*b* of the central block. These longitudinal stops make it possible to prevent any longitudinal displacement of the slab 20.

In addition, each side wall 32*c*, 32*d* comprises two lateral stops 36*a*, 36*b*, which extend into each notch of the slab 20. These lateral stops 36*a*, 36*b* are formed for example from elastomer and make it possible to prevent any lateral displacement of the slab relative to the pad 30.

According to the embodiment of the figures, each lateral stop 36*a*, 36*b* is formed by a threaded rod configured to be able to be screwed into an internal thread formed in the side wall 32*c*, 32*d* of the central block so as to be able to define the distance that separates the central block 32 from the slab 20.

As illustrated schematically in FIGS. 2, 4 and 5, the track section preferably comprises, at each longitudinal end 20*a*, 20*b* of the slab 20, 120 on either side of the notch 23, 24 arranged at this end, a threaded insert 27*a*, 27*b* arranged in the slab 20, 120 that opens out facing the plate 31 of the pad 30, 130. Each insert 27*a*, 27*b* is configured to be able to receive a lifting screw 28, which, once screwed, bears against the plate 31 of the pad 30, 130, which causes a vertical displacement of the slab 20 relative to the pad 30 anchored in the platform.

In other words, the combination of the threaded insert 27*a*, 27*b* and the lifting screw 28 allows means to be formed for vertically lifting the slab 20 relative to the pad 30. This particularly allows the shims 33*a*, 34*a* to be inserted in order to adjust the orientation and the position of the slab 20.

FIG. 5 schematically illustrates how a track section according to the invention can be adjusted. In particular, if during the initial adjustment of the track or following compaction of the ground, the geometry of the track section must be corrected, the invention makes it possible to modify the orientation of the slab, without destroying the track and without particular difficulties.

In particular, it is considered that the initial adjustment of the track consisted in arranging shims 33*a*, 34*a*, which respectively have heights H1 and H2, under the rounded bearing surfaces 21*c*, 22*c*.

The particular structure of the track section according to the invention allows the following adjustments to be made:

- adding a shim of thickness e on each of the two shims 33*a*, 34*a* (after lifting the slab 20 by means of the lifting screws 28 inserted into the inserts 27*a*, 27*b*) allows the slab 20 to be raised in the vertical direction by a height e;
- replacing the shims 33*a*, 34*a* with shims with respective thicknesses H1-e and H2-e (after lifting the slab 20 by means of the lifting screws 28 inserted into the inserts 27*a*, 27*b*) allows the slab to be lowered in the vertical direction by a height e;
- adding a shim of thickness e on the shim 33*a* and replacing the shim 34*a* with a shim H2-e allows the slab 20 to laterally displace by a distance e to the left of FIG. 5;
- adding a shim with thickness e on the shim 34*a* and replacing the shim 33*a* with a shim of thickness H1-e allows the slab 20 to laterally displace by a distance e to the right of FIG. 5;
- adding a shim of thickness e on the shim 34*a*, without modifying the shim 33*a*, allows the slab 20 to be pivoted with respect to a longitudinal axis in order to form a cant to the left of FIG. 5;

adding a shim of thickness e on the shim 33*a*, without modifying the shim 34*a*, allows the slab 20 to be pivoted with respect to a longitudinal axis in order to form a cant to the right of FIG. 5.

Thus, a pad of a track section according to the invention makes it possible to adjust the orientation of the slab simply with a minimum amount of standardized parts.

In the case of the construction of a new track or of the regeneration of a track, the invention allows the geometry of the track (height and cant) to be defined through the successive adjustment of the various pads supporting the various successive slabs of the track, following the installation of the various pads and of the various slabs on the pads.

In addition, with each slab resting on two successive pads, this frees up a space between the platform and the slab, which allows rainwater to flow under the slabs if necessary and allows insects and other amphibians living in the vicinity of the track to travel under the track. A track according to the invention is therefore more respectful of the ecosystem than the tracks of the prior art.

The invention is not limited to only the embodiments described with reference to the figures. In particular, a pad of a track section according to the invention can form the bearing surface of only one longitudinal end of a track slab and not of two longitudinal ends of two successive slabs as illustrated in the figures. Where applicable, the installation of a track requires twice as many pads, on an equivalent track, as the installation of the track for which each pad allows the two longitudinal ends of two successive slabs to be supported.

The invention claimed is:

1. A ballastless track section for a rail vehicle fastened on a track platform, wherein said track section comprises:

a prefabricated concrete track slab comprising two stringers extending along a longitudinal direction and, at each longitudinal end of the slab, a notch separating said stringers so as to form an H-shaped track slab;

for each stringer, a plurality of transverse supporting blocks for maintaining a longitudinal rail and mounted on an upper face of said stringer, and at each longitudinal end of the stringer, a rounded bearing surface borne by an underside of said stringer and having a curvature with a center of curvature which coincides with a top of said rail;

for each longitudinal end of said slab, a prefabricated support pad of at least said longitudinal end of the slab, said prefabricated support pad comprising a plate and a longitudinal central block projecting from said plate extending into the notch of said longitudinal end of said slab, once said slab is mounted on said pad, and delimiting, on one side of said central block, at least two support bases for the two longitudinal stringers of said longitudinal end of said slab, wherein said central block of at least one pad comprises at least one longitudinal stop borne by a longitudinal wall of said central block blocking any longitudinal displacement of the slab with the notch that receives a longitudinal wall of the central block;

each base comprising at least one shim of predetermined thickness arranged on said plate to support said rounded bearing surface of the stringer of said slab facing said base, once said slab is mounted on said pad;

for each support pad, foundation means for said support pad.

2. The track section according to claim 1, wherein at least one pad comprises, on one side of the central block, two support bases for two stringers separated by a transverse stiffening wall, the pad supporting two longitudinal ends of two consecutive slabs.

3. The track section according to claim 1, wherein said central block of at least one pad comprises at least one lateral stop mounted on a side wall of said central block blocking any lateral displacement of the slab, the notch receiving a side wall of the central block.

4. The track section according to claim 3, wherein said central block of at least one pad comprises at least one adjustable lateral stop defining a lateral space that separates said central block from each slab borne by said a-pad.

5. The track section according to claim 1, wherein said bases of at least one pad are inclined toward said central block.

6. The track section according to claim 1, wherein said slab further comprises, at each longitudinal end, on one side of said notch, at least one threaded insert arranged in said slab and emerging facing said plate of the pad bearing a end of the slab.

7. The track section according to claim 1, wherein said foundation means for at least one pad in said track platform comprise at least one pile per stringer support base.

8. The track section according to claim 1, wherein said rounded bearing surfaces of said longitudinal stringers of said slab are formed from an elastomer.

9. The track section according to claim 1, wherein said shims of predetermined thickness arranged on said plate of said pad are made of steel.

10. A ballastless track for a rail vehicle comprising:

a track platform and a plurality of track sections successively fastened to said track platform, the track sections comprising:

a prefabricated concrete track slab comprising two stringers extending along a longitudinal direction and, at each longitudinal end of the slab, a notch separating said stringers so as to form an H-shaped track slab;

for each stringer, a plurality of transverse supporting blocks maintaining a longitudinal rail and mounted on an upper face of said stringer, and at each longitudinal end of the stringer, a rounded bearing surface borne by an underside of said stringer and having a curvature with a center of curvature which coincides with a top of said rail;

for each longitudinal end of said slab, a prefabricated support pad of at least said longitudinal end of the slab, said prefabricated support pad comprising a plate and a longitudinal central block projecting from said plate extending into the notch of said longitudinal end of said slab, once said slab is mounted on said pad, and delimiting, on one side of said central block, at least two support bases for the two longitudinal stringers of said longitudinal end of said slab, wherein said central block of at least one pad comprises at least one longitudinal stop borne by a longitudinal wall of said central block blocking any longitudinal displacement of the slab with the notch that receives a longitudinal wall of the central block, each base comprising at least one shim of predetermined thickness arranged on said plate to support said rounded bearing surface of the stringer of said slab facing said base, once said slab is mounted on said pad;

for each support pad, foundation means for said support pad in said track platform.

* * * * *